United States Patent [19]

Chen

[11] Patent Number: 4,554,735

[45] Date of Patent: Nov. 26, 1985

[54] ONE-PIECE DISPOSABLE RAZOR

[75] Inventor: Evan N. Chen, Fairfield, Conn.

[73] Assignee: Warner-Lambert Company, Morris Plains, N.J.

[21] Appl. No.: 607,041

[22] Filed: May 4, 1984

[51] Int. Cl.[4] ..... B26B 21/00

[52] U.S. Cl. ..... 30/47; 30/58

[58] Field of Search ..... 30/47, 51, 58, 59, 75, 30/57, 63, 87

[56] References Cited

U.S. PATENT DOCUMENTS

| | | | |
|---|---|---|---|
| 2,426,117 | 8/1947 | Ostrovsky | 30/47 X |
| 2,720,697 | 10/1955 | Duncan | 30/47 |
| 3,136,056 | 6/1964 | Reyniere | 30/47 |
| 3,154,852 | 11/1964 | Westlake, Jr. | 30/51 |
| 4,184,247 | 1/1980 | Poisson | 30/59 |

*Primary Examiner*—E. R. Kazenske
*Assistant Examiner*—Willmon Fridie, Jr.
*Attorney, Agent, or Firm*—R. S. Strickler

[57] ABSTRACT

A one-piece plastic disposable razor having structure which insures safe and efficient blade geometry while lending itself to high-speed mass production methods.

1 Claim, 4 Drawing Figures

ONE-PIECE DISPOSABLE RAZOR

BACKGROUND OF THE INVENTION

The present invention relates to disposable razors and in particular to low cost single-edge disposable razors.

The invention also relates to one-piece razors where all elements of the razor are plastic save the metallic razor blade. Thus, the language "one-piece" relates to all elements of the razor except the blade or blades, as the case may be.

A prior art razor over which the present invention is an improvement is disclosed and described in U.S. Pat. No. 3,154,852 issued Nov. 3, 1964, to E. B. Westlake, Jr. The '852 reference shows a one-piece razor with a replaceable double-edge blade.

SUMMARY OF THE INVENTION

A particular feature of the present invention is the provision of a low cost disposable plastic razor.

A further feature of the invention is the provision of a razor of the above general class which includes structure for insuring the integrity and preservation of so-called blade geometry.

The language "blade geometry" is intended to relate to the optimum position of the blade edge relative to the razor guard bar and the razor cap which must be achieved and preserved to insure safety.

It is a further feature of the invention to provide a low cost one-piece plastic disposable razor susceptible of manufacture by means of high-speed mass production methods while maintaining the integrity and continuous quality of blade geometry.

A razor embracing certain features of the present invention may comprise two basic plastic elements, one of said elements defining a handle, the other of said elements defining a cap, hinge means connecting both elements to facilitate relative rotation of said elements from a first or open position to a second or closed position and latch means for retaining the elements in the closed position with a single blade having a single cutting edge sandwiched therebetween.

Other features and advantages of the present invention will become more apparent from an examination of the succeeding specification when read in conjunction with the appended drawings, in which;

DESCRIPTION OF THE PREFERRED EMBODIMENT

Figure 1:
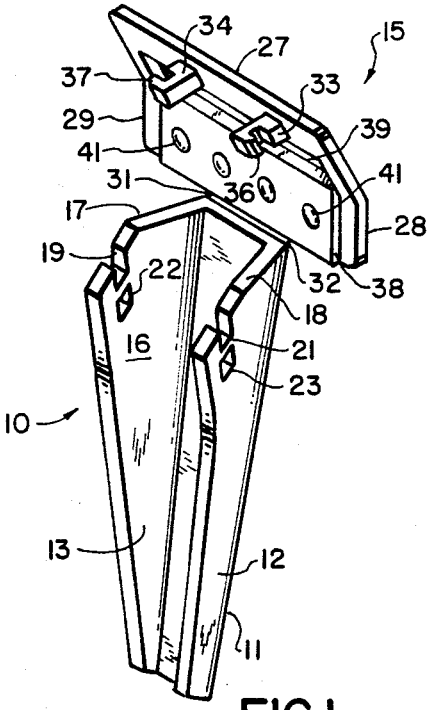
FIG. 1 is a perspective view of my novel razor in the open position.
Figure 2:
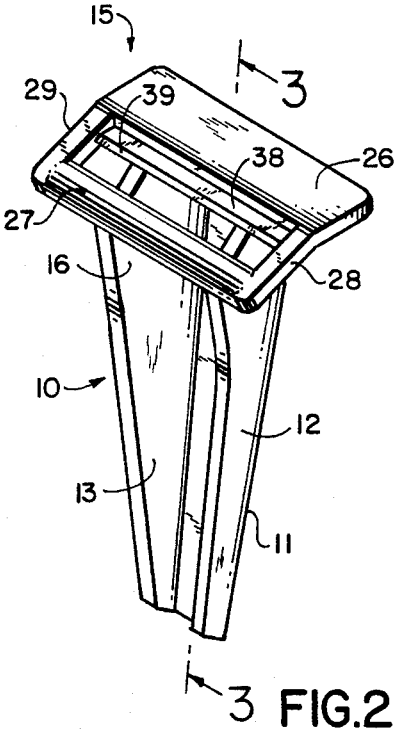
FIG. 2 is a similar view of the razor in the closed position.
Figure 3:
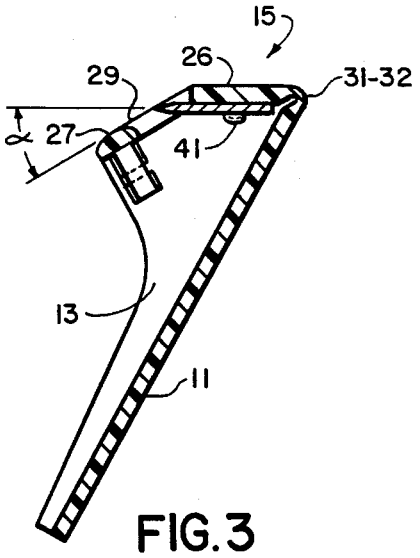
FIG. 3 is a vertical section of FIG. 2 as viewed in the plane of the line 3—3 and in the direction indicated by the arrows.
Figure 4:
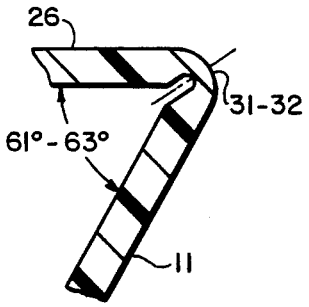
FIG. 4 is an enlarged view of the hinge section of FIG. 3.

Referring to FIGS. 1, 2 and 3, a one-piece plastic razor comprising two basic elements indicated generally by the reference numerals 10 and 15 includes a handle 11 having a pair of spaced ribs or fins 12 and 13 each terminating in support elements or shoulders 14 and 16 having coplanar top surfaces 17 and 18. That is, surfaces 17 and 18 define a plane.

Shoulders 14 and 16 are each formed with notches 19 and 21 and slots 22 and 23.

The basic element 15, hinged to the basic element 10 by hinges 31 and 32, includes a razor cap 26 and a guard bar 27 connected to cap by ribs 28 and 29.

The elements 10 and 15 and the hinges 31 and 32 are cast or molded of plastic material so as to define a single piece-part.

The element 15 is formed with a pair of projections or protuberances defining lugs 33–34 and claws 36 and 37.

The lugs 33–34 are received within and mate with notches 19 and 21 respectively when the element 15 is rotated from the open or first position of FIG. 1 to the closed or second position of FIG. 2.

At the same time the claws 36 and 37 are received within and make a snap fit with slots 22 and 23 to retain the two basic elements in the closed position.

As is apparent in FIG. 1, when the basic elements 10 and 15 are in the open position, a single blade 38 having a single edge 39 is secured to the cap 26 by upsetting plastic rivets 41—41 in well-known fashion.

Obviously two blades could be so secured with an appropriate spacer therebetween if desired.

Thus, in the succeeding claims, reference to a "blade" or a "single blade" is intended to include one or more blades.

The planar surface generated by the top surfaces 17 and 18 in combination with the cooperation between lugs 33–34 and mating notches 19 and 21 are very important elements of this invention. These members control and insure good blade geometry.

It is well known that blade edge exposure, i.e., blade geometry, is critical to an efficient, safe shave.

That is, too much edge exposure is unsafe and too little is inefficient.

Since the hinges 31–32 are flexible and of relatively light or thin construction, they cannot be relied upon to place the blade upon the surfaces 17 and 18 in the correct position relative to handle 11.

The planar surface generated by fairly extensive top surfaces 17–18 and the locking effect of the lugs 33–34 received in notches 19 and 21 insures good, safe and efficient blade geometry from razor to razor while leading itself to high-speed mass production methods.

It is anticipated that a wide variety of modifications and design changes may be devices in the present invention without departing from its spirit and scope.

For example, the fins 12 and 13 may be individually connected to the medial portion of the handle 11 by a "living" hinge so that the handle is molded flat and thereafter the fins 12 and 13 are rotated to the position of FIGS. 1 and 2.

What is claimed is:

1. A disposable one-piece plastic razor comprising:

two basic plastic elements, one of said elements defining a handle, the other of said elements defining a cap, hinge means connecting both elements to facilitate relative rotation of said elements from a first or open position to a second or closed position and latch means for retaining the elements in the closed position with a single blade having a single cutting edge fixed to the cap and sandwiched therebetween, said hinge means having an axis parallel to said cutting edge, said handle being formed with a pair of spaced support elements having coplanar surfaces for supporting the blade and fixing the degree of relative rotation of said elements, said latch means defining a pair of claws formed integrally with said cap and a mating pair of slots formed in said spaced support elements, said claws being operative to engage said slots in said closed position, said latch means further defining a pair of lugs depending from the cap cooperating with a pair of mating notches formed in the spaced support elements operative to align the cap and thus the blade edge relative to the handle and to fix and retain the desired degree of relative rotation between the cap and the handle.

* * * * *